US005181296A

United States Patent [19]

Williams

[11] Patent Number: 5,181,296

[45] Date of Patent: Jan. 26, 1993

[54] REINFORCED CARRIER DISC FOR OPERABLE PARTITION SYSTEM

[75] Inventor: Charles E. Williams, Delavan, Wis.

[73] Assignee: Hufcor, Inc., Janesville, Wis.

[21] Appl. No.: 815,380

[22] Filed: Dec. 31, 1991

[51] Int. Cl.[5] ..... E05D 13/02; A47H 15/00

[52] U.S. Cl. ..... 16/95 R; 16/89; 16/104; 16/106; 104/94

[58] Field of Search ..... 104/94, 111; 16/89, 16/91, 95 R, 96 R, 97, 103, 104, 105, 106, 107

[56] References Cited

U.S. PATENT DOCUMENTS

| | | | |
|---|---|---|---|
| 3,042,960 | 7/1962 | Spork | 16/105 |
| 3,879,799 | 4/1975 | Williams | 16/89 |
| 4,141,106 | 2/1979 | Dixon | 16/106 |
| 4,401,033 | 8/1983 | Gerken | 16/106 |
| 4,837,891 | 6/1989 | Toma et al. | 16/95 R |
| 4,991,257 | 2/1991 | Eutebach | 16/95 R |

*Primary Examiner*—W. Donald Bray
*Attorney, Agent, or Firm*—Michael, Best & Friedrich

[57] ABSTRACT

A multidirectional carrier and track generally comprising a disc, a track, and structure on the track defining a disc supporting surface. The disc is supported for rotation about an axis. The disc is in engagement with the disc supporting surface and has first and second ball bearing assemblies. The ball bearing assemblies have inner and outer races, the inner races mounted adjacent one another along the axis. The disc also has an outer cylindrical rim portion, the rim portion have an inner-facing surface, an outer-facing surface and upper and lower surfaces, the inner-facing surface engaging the outer races and the lower surface contacting the track. Structure on the inner-facing surface defines axially spaced faces projecting radially inward towards the axis in step-wise fashion, forming two axially-facing shoulders projecting from the inner-facing surface. The outer races contact the shoulders and are held in the outer rim portion against axial movement in one direction relative to the axis of the support member. A cylindrical reinforcing band surrounds and reinforces the rim portion.

15 Claims, 1 Drawing Sheet

REINFORCED CARRIER DISC FOR OPERABLE PARTITION SYSTEM

BACKGROUND OF THE INVENTION

This invention relates to a multidirectional suspension system for operable partitions and, more particularly, to operable partition arrangements involving discrete panels suspended from an overhead track that are movable along the track between a point of intended use and a storage area removed from the space to be subdivided.

Where large spaces are intended to be temporarily subdivided into smaller rooms in, for example, hotels, clubs, convention halls, and the like, usually a partition suspension system is provided which permits movement of subdividing panels between the point of intended use and a storage area that is removed from the space being subdivided. These involve an overhead track arrangement commonly made up of straight sections of track and right angled turns, crossovers, and T-intersections interspersed with the straight track sections.

Panels in systems of this type can be large and heavy. In many installations, the panels have to be acoustically designed for minimum transmission of sound through the panels. That can add to the weight of the individual panels.

Panels in operable partition systems of this type are usually separately supported from the track system in an unhinged relationship, and by a pair of carriers located one adjacent both the leading and trailing edges of the respective panels. The individual panels are moved from the storage area to points of use by moving them along the track straightaways on the carriers and then, as required by the track layout, around right angle turns and/or across intersections.

In known bearing carrier arrangements, such as that disclosed in U.S. Pat. No. 3,879,799, each carrier consists of a bolt that is attached to the top of a panel and a pair of coaxially journaled discs for rotation about the bolt on the track. Two bearings are pressed fit within each disc, one from either end, and the bearings are separated by a portion of the disc which provides additional support against the downward force of the load of the panels. In this known arrangement, the bolt has been known to crack or pull through this disc material under load, causing premature failure of the carriers. One response to this has been to utilize heavier materials or a larger disc in the carriers, but the size and weight of the discs can only be increased so far before the other performance characteristics of the carriers, for instance the provision of smooth and easy movement within the tracks, is adversely affected.

SUMMARY OF THE INVENTION

Among the objects of this invention is to provide a multidirection carrier and track system that delivers relatively smooth, maintenance-free operation.

A more specific object is to provide such a system where the disc components are reinforced against premature disc failure.

Another object is to provide an improved disc for a multidirection carrier and track system that is of a lightweight and yet durable construction.

For the achievement of these and other objects, this invention provides a multidirectional carrier and track system which generally includes a track, structure on the track defining a disc supporting surface, and a disc. Also included is structure defining an axis, such as a carrier bolt, which supports the disc and about which the disc is rotatable while the lower surface of the disc engages the disc supporting surface of the track.

The carrier disc itself has first and second bearings, i.e., ball bearings having inner and outer races. The inner races are mounted adjacent one another along the axis. The disc has an outer cylindrical rim portion, the rim portion having an inner-facing surface, an outer-facing surface and upper and lower surfaces. The lower surface contacts the disc supporting surface of the track. The inner facing surface is generally cylindrical, and engages the outer bearing races. Preferably, the inner facing surface includes structure defining spaced faces projecting radially inward towards the axis in step-wise fashion, thus forming first and second axially-facing, and axially spaced, surfaces projecting from the inner-facing surface. The two outer races are in contact with respective axially facing surfaces and are thereby held in the outer rim portion against axial movement in one direction relative to the axis of the support member.

In one embodiment the inner facing surface has a first diameter at one end of the disc and a second smaller diameter removed from that end. These first and second diameters form at their juncture the first of the axially-facing surfaces. A third diameter, smaller than the second diameter, is at the opposite end of the disc, and the second and third diameters form at their juncture the second axially-facing surface.

In another embodiment a generally cylindrical reinforcing band surrounds and is in contact with at least a portion of the outer-facing surface of the outer cylindrical rim portion. The band reinforces the cylindrical rim and shields the more frágile rim portion from contact with corners or other projections in the track system.

By incorporating a new arrangement of a pair of bearings and having a steel band surrounding the rim portion of the disc, the overall strength and durability, and thereby the load carrying capacity, of the carrier disc system is greatly improved.

Other features and advantages of the invention will become apparent to those of ordinary skill in the art upon review of the following detailed description, claims, and drawings.

DESCRIPTION OF THE PREFERRED EMBODIMENT

Figure 2:
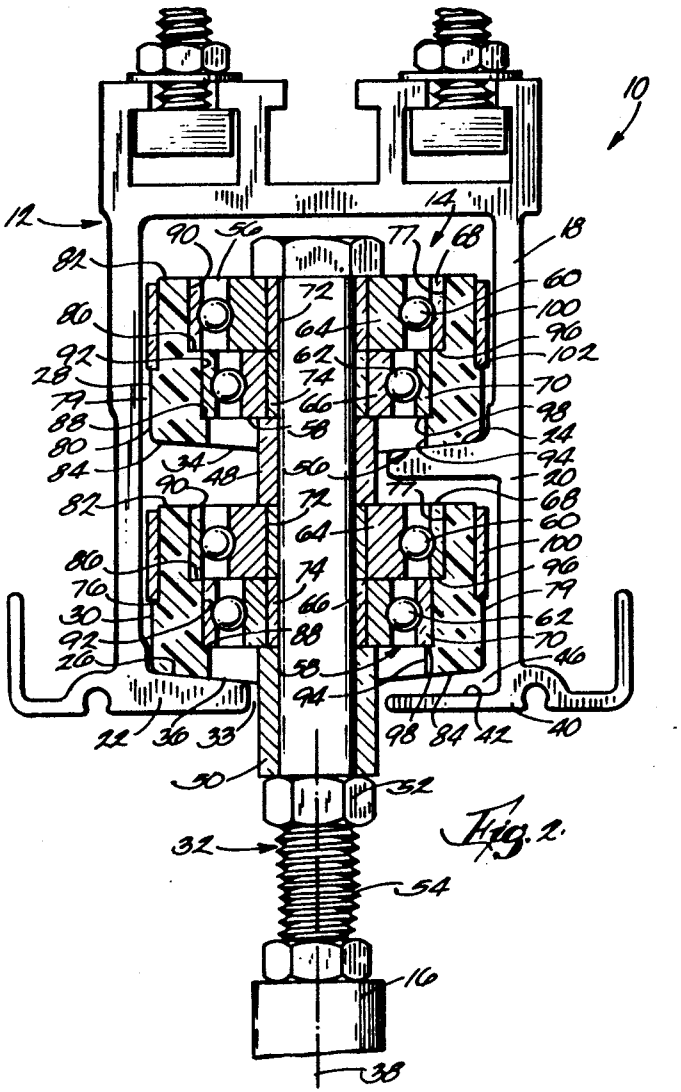
FIG. 2 is an axial cross section of the system depicted in FIG. 1, showing the internal construction of the carrier discs.
Figure 1:
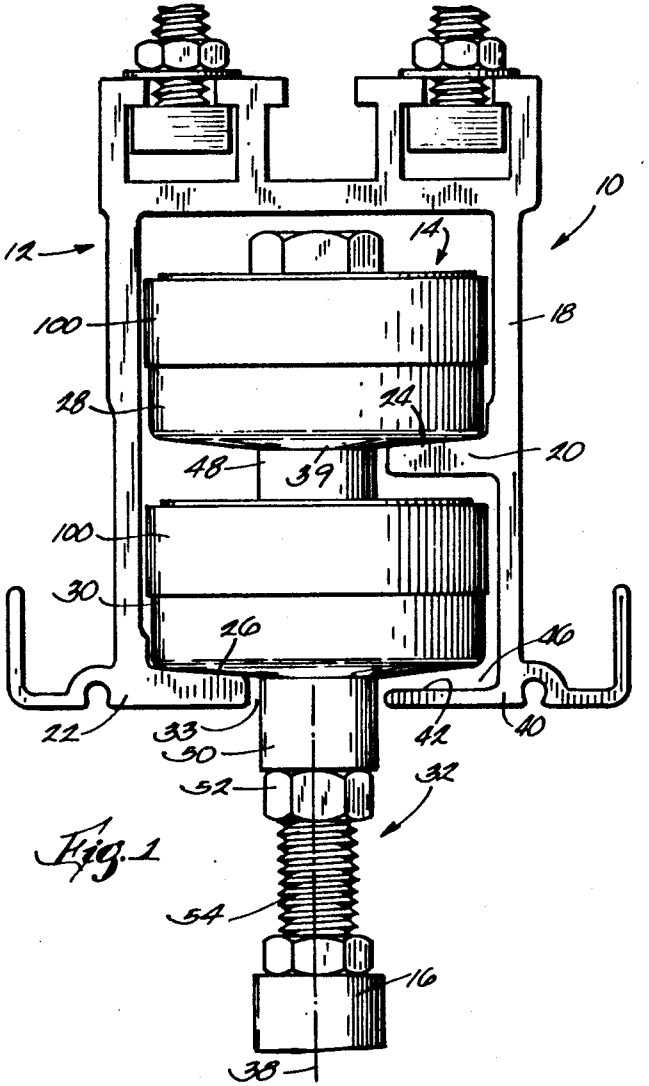
FIG. 1 is a view of the reinforced carrier disc for an operable partition system and constructed in accordance with this invention and in supporting contact with a trackway.

A carrier system 10 embodying the invention is illustrated in FIGS. 1 and 2. The system 10 is such as is used with an operable partition (not shown) suspended from a track system 12, generally through at least two carriers 14 (only one depicted). In the preferred arrangement, one carrier is connected adjacent each of the vertical edges of each panel 16. The track system 12 is made up of sections of track 18.

With reference to the drawings, the preferred track section 18 includes two generally horizontal ledges 20 and 22, with upper facing surfaces 24 and 26, respectively. The ledges 20 an 22 are spaced apart horizontally and vertically, thus constituting a pair of vertically spaced rollerway defining ledges disposed on either side of the track.

Each carrier 14 preferably includes two discs 28 and 30 positioned one above the other and supported for rotation about a vertical bolt 32. The preferred disc material is one which is relatively lightweight, such as a synthetic plastic material, and most preferred would be such a material which is also self-lubricating against the track system, as long as it displays suitable bearing and structural characteristics. The discs have lower, or load support surfaces 34 and 36, which rest on a respective one of the disc supporting surfaces 24 and 26. Each of the discs thus engage only one of the ledges, 20 or 22, and on opposite sides of bolt 32. The bolt 32 moves in the slot 33 between the track ledges 20 and 22 and the discs 28 and 30 are coaxially journaled on the bolt 32 for rotation, the bolt 32 defining an axis of rotation 38. The discs 28 and 30 are thus capable of rolling movement on the disc supporting surfaces 24 and 26 as the carrier 14 moves through the track section 18. The arrangement is such that the load support surface 34 of the upper disc 28 rides on the upper disc supporting surface 24 and is free of any other ledge contact and the load support surface 36 of the lower disc 30 rides on the lower disc supporting surface 26 and is likewise free of any other ledge contact. The result is that the discs 28 and 30 are free to rotate and roll in opposite directions along the respective disc supporting ledges 24 and 26, as the panels 16 are moved along the track system 12. Moreover, they tend to keep the bolt 32, and thus, the carrier, upright and centered in the slot.

The track 18 is preferably made of extruded aluminum or formed steel, most preferably a precision and heavy-duty anodized aluminum track. In the preferred construction, only one ledge 20 is provided under disc 28 as there is no need for a disc on the left hand side of the track 18. With respect to the other disc 30, it should be similarly noted that only one ledge 22 need be provided under the disc 30, but for aesthetic purposes a masking ledge 40 is provided on the right hand side of disc 30 as viewed in the drawings. The lower disc 30 is spaced from the upper surface 42 of the masking ledge 40 so that the disc 30 remains free to rotate as a result of engagement with only disc supporting surface 26. This is accomplished by providing the masking ledge 40 with a thickness which is less than the thickness of lower ledge 22, thereby providing a space 46 between the disc 30 and surface 42.

A spacer 48 is provided on the bolt 32 and maintains the vertical spacing between the discs 28 and 30. Similarly, a spacer 50 is provided under the lower disc 30 and between it and a nut 52 which is engaged on the lower threaded portion 54 of the bolt 32. Threaded portion 54 of the bolt 32 is suitably attached to the top of the panel 16 in a conventional manner (not shown). Much of the above structure and operation is similar to that already disclosed in my prior U.S. Pat. No. 3,879,799.

The improved disc system offers quieter, smoother panel movement even with higher weights encountered in tall, heavy panels. The discs 28 and 30 are identically constructed so identical numbers will be used to identify identical internal parts in both discs (FIG. 2). Each disc 28 and 30 includes first and second radial ball bearing assemblies 56 and 58 engaged on the bolt 32. Two bearings in each wheel provide a better rolling effect which, as with the dual horizontal disc design, then provide a relatively large bearing surface at two track levels for a smooth performance which minimizes hang-ups at intersections or in going into or out of remote storage areas.

More specifically, balls 60 and 62 are held between inner races 64 and 66 and outer races 68 and 70. Two bearing sleeves, 72 and 74 are disposed on the bolt 32. The inner races 64 and 66 are mounted adjacent one another along the bolt 32 and have a press fit onto the bearing sleeves 72 and 74. The inner races 64 and 66 are thereby fixed relative to the bolt 32. For the upper disc 28, the lower bearing sleeve 74 and inner race 66 are adjacent the disc spacer 48, while for the lower disc 30, the sleeve 74 and inner race 66 are adjacent the lower spacer 50.

Each disc 28 and 30 also has and outer cylindrical rim 76. The rim 76 has an inner-facing surface 77, which engages the outer races 68 and 70, as well as an outer-facing surface 79 and upper and lower surfaces 82 and 84, respectively. The lower surface 84 of respective discs 28 and 30 contacts the trackway ledges 20 and 22, and these lower surfaces 84 form the actual load support surfaces 34 and 36, respectively. A synthetic polymeric material is preferred for the rim 76 which is the basic body of the discs and it provides smoother and quieter operation on the tracks. A preferred disc material is a lightweight synthetic plastic that is also self-lubricating, such as nylon.

The rim 76 rotates on the balls 60 and 62 about axis 38 with the outer races 68 and 70, and relative to the fixed races 62 and 64 and the bolt 32. The inner facing surface 77 of the rim 76 is generally cylindrical including faces projecting inward towards the axis 38 in step-wise fashion, forming first and second radially extending, axially-facing surfaces 86 and 88. In the preferred embodiment the first and second surfaces 86 and 88 and the inner-facing surface 76 define three distinct portions with different diameters. The first diameter 90 is adjacent one axial end of the rim 76, in the drawings this one end being at upper surface 82. A second, smaller diameter 92 is spaced inwardly of that end and first diameter 90, and these first and second inner diameters 90 and 92 form the first shoulder 86 at their juncture. A third diameter 94, which is smaller than the second diameter 92, is adjacent the opposite end of the rim, i.e, at lower surface 84, with the second and third inner diameters 92 and 94 forming the second shoulder 88 at their juncture.

The first and second outer races 68 and 70 have lower surfaces 96 and 98 respectively. The outer races 68 and 70 are in contact with the first and second diameters 90 and 92 of the inner facing surface 77, and also with the axially facing shoulders 86 and 88. More specifically, the lower surface 96 of the first outer race 68 rests on shoulder 84, while the lower surface 98 of the second outer race 70 rests on the shoulder 86. The outer races 68 and 70 are thereby held in the rim 76 against axial movement in a downward direction relative to the axis 38 and as viewed in the drawing. This shoulder arrangement for mounting the individual bearings provides a substantial surface in axial direction for support, and thereby increases the resistance of the load acting to pull the bolt/bearing component axially through the disc. In other words, the carrier can support a heavier panel without risk of a pull-through.

A reinforcing band 100, preferably of a metal, such as steel, encircles discs 28 and 30, and is preferably disposed around the upper portion of the rim 76. The band 100 reinforces the rim 76. Although the support arrangement of the bearings 68 and 70 reduces the danger of pull through, there remains the potential that the forces under load could causes radial cracks and splits in the rim 76. The reinforcing band 100 counteracts splitting of the rim. Band 100 is preferably a continuous cylindrical member press fit onto rim 76 and against radial shoulder 102.

The rim 76 could be also damaged from contacting corners or projections within the track. The band 100 preferably has a greater outer diameter than the outer diameter of the rim 76 so that it projects vertically from the rim. Any contact between the rim 76 and a corner or projection of the track is encountered first, and to a great extent absorbed, by the band 100, thereby further protecting the rim 76 from damage.

Although several embodiments of the present invention have been illustrated and described, it will be apparent to those skilled in the art that various changes and modifications may be made therein without departing from the spirit of the invention or from the scope of the appended claims.

What is claimed is:

1. A multidirectional carrier and track comprising, in combination, a track, means on said track defining a disc supporting surface, a disc, means defining an axis and supporting said disc for rotation about said axis and with said disc in engagement with said disc supporting surface, said disc including first and second bearing assemblies, said bearing assemblies having inner and outer races, said inner races mounted adjacent one another along said axis, an outer cylindrical rim portion, said rim portion having an inner-facing surface, an outer-facing surface and upper and lower surfaces, said inner-facing surface engaging said outer races and said lower surface contacting said track, and means on said inner-facing surface defining spaced faces projecting radially inward towards said axis in step-wise fashion, forming two axially spaced, radially extending shoulders projecting from said inner-facing surface, said outer races in contact with said shoulders and thereby held in said outer rim portion against axial movement in one direction relative to the axis of said support member.

2. The multidirectional carrier of claim 1 wherein said inner-facing surface is generally cylindrical, said inner-facing surface has a first diameter extending inwardly from one end of said disc, a second smaller diameter removed from said one end spaced, relative to said one end, inward from said first diameter, said first and second diameters forming at their juncture a first axially-facing shoulder, and a third diameter smaller than said second diameter between said second diameter and the opposite end of said disc, said second and third diameters forming at their juncture a second axially-facing shoulder.

3. The multidirectional carrier of claim 1 wherein said rim portion is a synthetic plastic material.

4. The multidirectional carrier of claim 1 wherein a generally cylindrical reinforcing band surrounds and is in contact with at least a portion of said outer-facing surface of said rim portion.

5. The multidirectional carrier of claim 4 wherein said band is metal.

6. The multidirectional carrier of claim 4 wherein said band has a greater outer diameter than the outer diameter of said rim portion.

7. The multidirectional carrier of claim 6 including means defining a shoulder in the outside surface of said rim portion defining an axially facing surface and said band having an edge engaging said shoulder in said rim portion outside surface.

8. The multidirectional carrier of claim 1 having first and second discs in coaxially spaced relation along said axis both constructed as defined in claim 1, and first and second tracks having respective first and second disc supporting surfaces for engaging said first and second discs.

9. A multidirectional carrier and track comprising, in combination, a track, means on said track defining a disc supporting surface, a disc, means defining an axis and supporting said disc for rotation about said axis and with said disc in engagement with said disc supporting surface, said disc including first and second ball bearing assemblies, said bearing assemblies having inner and outer races, said inner races mounted adjacent one another along said axis, an outer cylindrical rim portion, said rim portion having an inner-facing surface, an outer-facing surface and upper and lower surfaces, said inner-facing surface engaging said outer races and said lower surface contacting said track, a generally cylindrical reinforcing band surrounding and in contact with at least a portion of said outer-facing surface, and means on said inner-facing surface defining axially spaced, radially facing surfaces projecting radially inward towards said axis in step-wise fashion and forming two axially spaced shoulders projecting from said inner-facing surface, said outer races in contact with said shoulders and thereby held in said outer rim portion against axial movement in one direction relative to the axis of said support member.

10. The multidirectional carrier of claim 9 wherein said inner surface is generally cylindrical, said inner surface has a first diameter extending inwardly from one end of said disc, a second smaller diameter removed from said one end spaced, relative to said one end, inward from said first diameter, said first and second diameters forming at their juncture a first axially-facing shoulder, and a third diameter smaller than said second diameter between said second diameter and the opposite end of said disc, said second and third diameters forming at their juncture a second axially-facing shoulder.

11. The multidirectional carrier of claim 9 wherein said rim portion is a synthetic plastic material.

12. The multidirectional carrier of claim 9 wherein said band is metal.

13. The multidirectional carrier of claim 9 wherein said band has a greater outer diameter than the outer diameter of said rim portion.

14. The multidirectional carrier of claim 13 including means defining a shoulder in the outside surface of said rim portion defining an axially facing surface and said land having an edge engaging said shoulder in said rim portion outside portion.

15. The multidirectional carrier of claim 9 having first and second discs in coaxially spaced relation along said axis both constructed as defined in claim 1, and first and second tracks having respective first and second disc supporting surfaces for engaging said first and second discs.

* * * * *